US012258750B2

(12) United States Patent
Winters

(10) Patent No.: US 12,258,750 B2
(45) Date of Patent: Mar. 25, 2025

(54) BUILDING STRUCTURE AND METHODS OF ASSEMBLY THEREOF

(71) Applicant: Peter Winters, Carmel, IN (US)

(72) Inventor: Peter Winters, Carmel, IN (US)

( * ) Notice: Subject to any disclaimer, the term of this patent is extended or adjusted under 35 U.S.C. 154(b) by 0 days.

(21) Appl. No.: 18/655,702

(22) Filed: May 6, 2024

(65) Prior Publication Data

US 2024/0287787 A1 Aug. 29, 2024

Related U.S. Application Data

(63) Continuation of application No. 17/842,011, filed on Jun. 16, 2022, now Pat. No. 12,006,679.

(60) Provisional application No. 63/211,776, filed on Jun. 17, 2021.

(51) Int. Cl.

| | |
|---|---|
| ***E04B 1/32*** | (2006.01) |
| ***E04B 1/61*** | (2006.01) |
| ***E04B 2/00*** | (2006.01) |
| ***E04C 2/32*** | (2006.01) |
| *E04B 1/00* | (2006.01) |
| *E04C 2/00* | (2006.01) |
| *E04C 2/20* | (2006.01) |

(52) U.S. Cl.

CPC ..... *E04B 1/3205* (2013.01); *E04B 1/6116* (2013.01); *E04C 2/322* (2013.01); *E04C 2/44* (2013.01); *E04B 2001/0053* (2013.01); *E04B 2001/3276* (2013.01); *E04C 2002/004* (2013.01); *E04C 2/20* (2013.01)

(58) Field of Classification Search

CPC ..... E04B 1/3205; E04B 1/6116; E04B 2001/0053; E04B 2001/3276; E04C 2/322; E04C 2/44; E04C 2/20; E04C 2002/004

See application file for complete search history.

(56) References Cited

U.S. PATENT DOCUMENTS

| | | | | |
|---|---|---|---|---|
| 2,336,228 A | | 12/1943 | Norman | |
| 2,944,370 A | | 7/1960 | Malarkey | |
| 3,009,509 A | | 11/1961 | Martin | |
| 4,071,986 A | | 2/1978 | Wickwire | |
| 4,186,541 A | * | 2/1980 | Sivachenko | E04B 2/56 52/630 |

(Continued)

FOREIGN PATENT DOCUMENTS

| | | |
|---|---|---|
| FR | 1478123 A | 4/1967 |
| GB | 770062 A | 3/1957 |

(Continued)

*Primary Examiner* — Adriana Figueroa

(74) *Attorney, Agent, or Firm* — Dinsmore & Shohl LLP

(57) ABSTRACT

A building panel is provided. The building panel includes an exterior wall portion, an interior wall portion, a pair of opposing sidewalls, a first end portion and an opposite second end portion. The pair of opposing sidewalls spacing apart the interior wall portion from the exterior wall portion to define a cavity therebetween. The exterior wall portion, the interior wall portion and the pair of opposing sidewalls are arcuate in shape to define the building panel. The first end portion has a slip lock slot extending between the pair of opposing sidewalls. The second end portion has a slip lock tab member extending between the pair of opposing sidewalls. The slip lock slot of the building panel is configured to receive the slip lock tab member of a second building panel to adjoin the first and second building panels in a continuous fashion.

20 Claims, 11 Drawing Sheets

(56) References Cited

U.S. PATENT DOCUMENTS

| | | | | |
|---|---|---|---|---|
| 4,653,238 | A * | 3/1987 | Berman | E04H 1/005 D25/18 |
| 6,550,216 | B1 | 4/2003 | Ohanesian | |
| 6,715,243 | B1 | 4/2004 | Fons | |
| 7,802,412 | B2 | 9/2010 | Jensen | |
| 9,371,641 | B2 | 6/2016 | Christensen | |
| 9,869,090 | B2 | 1/2018 | Wilson | |
| 10,407,895 | B2 * | 9/2019 | Krohmer | E04B 7/102 |
| 2016/0222657 | A1 | 8/2016 | Anson | |
| 2017/0254105 | A1 * | 9/2017 | Seiford, Sr. | E04B 1/3211 |
| 2022/0341164 | A1 * | 10/2022 | Santander Lora | E04B 7/08 |

FOREIGN PATENT DOCUMENTS

| | | | |
|---|---|---|---|
| KR | 20070092799 | A | 9/2007 |
| WO | 2013066116 | A2 | 5/2013 |

* cited by examiner

BUILDING STRUCTURE AND METHODS OF ASSEMBLY THEREOF

CROSS-REFERENCE TO RELATED APPLICATION

The present application is a continuation application of co-pending U.S. patent application Ser. No. 17/842,011 filed on Jun. 16, 2022, entitled "Building Structure and Methods of Assembly", which in turn claims priority to U.S. Provisional Patent Application Ser. No. 63/211,776 filed on Jun. 17, 2021, and entitled "Arcuate Building Panel and Method for Use," the contents of both are incorporated herein in their entirety.

TECHNICAL FIELD

The present specification generally relates to building panels for structure and, more specifically, prefabricated arcuate building panels to form a tubular building structure.

BACKGROUND

Most buildings utilize traditional construction techniques in the form of a foundation that is then built upon with frame members to construct walls that are then topped with a roof. Various additional materials are attached to these structures to form a cohesive unit fit for living. Generally, and traditionally, these materials are delivered to a worksite and assembled in place. Although this assembly technique has been useful, there exists a need to improve both the types of materials and this traditional construction technique, wherein the materials can be lessened or improved, and the construction time and process can be accelerated.

SUMMARY

In one embodiment, a building panel is provided. The building panel includes an exterior wall portion, an interior wall portion, a pair of opposing sidewalls, a first end portion and an opposite second end portion. The pair of opposing sidewalls are connected to the exterior wall portion and the interior wall portion spacing apart the interior wall portion from the exterior wall portion to define a cavity therebetween. The exterior wall portion, the interior wall portion and the pair of opposing sidewalls are arcuate in shape to define the building panel. The first end portion has a slip lock slot extending between the pair of opposing sidewalls. The second end portion has a slip lock tab member extending between the pair of opposing sidewalls. The slip lock slot of the building panel is configured to receive the slip lock tab member of a second building panel to adjoin the first and second building panels in a continuous fashion.

In another embodiment, a building structure is provided. The building structure includes a plurality of building panels interlocked to form an annular segment. Each of the plurality of building panels includes an exterior wall portion, an interior wall portion, a pair of opposing sidewalls connected to the exterior wall portion and the interior wall portion, a first end portion, and an opposite second end portion. The pair of opposing sidewalls space apart the interior wall portion from the exterior wall portion to define a cavity therebetween. The exterior wall portion, the interior wall portion and the pair of opposing sidewalls are arcuate in shape to define each of the plurality of building panels. The first end portion has a slip lock slot extending between the pair of opposing sidewalls. The opposite second end portion has a slip lock tab member extending between the pair of opposing sidewalls. Each of the pair of opposing sidewalls has a recess portion with a plurality of receiving connectors positioned therein, and each of the pair of opposing sidewalls having a plurality of protrusions extending therefrom. The slip lock slot of one the plurality of building panels is configured to receive the slip lock tab member of another one of the plurality of building panels and such an arrangement continues with the remaining plurality of building panels to form the annular segment.

A building structure is provided. The building structure includes a first plurality of arcuate building panels interlocked to form a first annular segment and a second plurality of arcuate building panels forming a second annular segment. The first plurality of arcuate building panels include a first pair of opposing sidewalls, a first end portion having a first slip lock slot, an opposite second end portion having a first slip lock tab member, and each of the first pair of opposing sidewalls having a plurality of protrusions extending therefrom. The first slip lock slot of one the first plurality of arcuate building panels is configured to receive the first slip lock tab member of another one of the first plurality of arcuate building panels and such an arrangement continues with the remaining first plurality of arcuate building panels to form the first annular segment. The second plurality of arcuate building panels include a second pair of opposing sidewalls, a first end portion having a second slip lock slot, an opposite second end portion having a second slip lock tab member, and each of the second pair of opposing sidewalls having a recess portion with a plurality of receiving connectors positioned therein. The second plurality of arcuate building panels are interlocked by the second slip lock slot of one the second plurality of arcuate building panels receives the second slip lock tab member of another one of the second plurality of arcuate building panels and such a second arrangement continues with the remaining second plurality of arcuate building panels to form the second annular segment. An interconnection between the first annular segment and the second annular segment is formed when the plurality of protrusions are received within and between each of the plurality of receiving connectors within the recess portion to couple to the plurality of protrusions to the plurality of receiving connectors to form a tubular structure with a bore extending there through.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments described herein are directed to improved building panels and method for use of assembling the building panels in constructing a cohesive tubular structure that forms a livable space. The building panels described herein are generally arcuate in shape and include a specific structure to enable the fitment and connection of a plurality of adjacent panels into the cohesive annular segment with a bore extending there through that defines the livable space. Each of the building panels incorporate structure, moisture barrier, air gap, interior finish support system, ventilation ductwork, and interconnection components into a singular form to form the livable structure. Further, the livable structure may be positioned within a portion of earth, positioned on an earth surface, or may be positioned above the earth surface.

Each of the building panels of the present disclosure are generally arcuate in shape having a predetermined continuous arc at a predetermined degree depending on a desired diameter of the livable structure. Further, each of the building panels is generally a corrugated hollow body that includes an exterior wall portion, an interior wall portion and a pair of opposing sidewalls that space apart the interior wall portion from the exterior wall portion to define a cavity therebetween. Each of the building panels have a first end portion have a slip lock slot extending between the pair of opposing sidewalls and an opposite second end that has a slip lock tab member extending between the pair of opposing sidewalls. Further, each of the building panels include a recess portion with a plurality of receiving connectors positioned on each sidewall and a plurality of protrusions extending from each sidewall.

To form the annular segment, the slip lock slot of one building panel is configured to receive the slip lock tab member of on adjacent building panel and so on. Additional building panels are used to form an infinite number of additional annular segments. The additional annular segment is affixed to couple to the annular segment together with the seams in an offset manner. In embodiments, the plurality of receiving connectors of the annular segment receive the plurality of protrusions of the adjacent additional annular segment and the plurality of receiving connectors of the adjacent additional annular segment receive the plurality of protrusions of the annular segment to affix or couple the segment to one another in both an end-to-end fashion and sidewall-to-sidewall (edge-to-edge) fashion forming the cohesive tubular shape with the bore that defines the interior space that may be finished with both traditional and non-traditional building materials to create an inviting living space.

Figure 1:
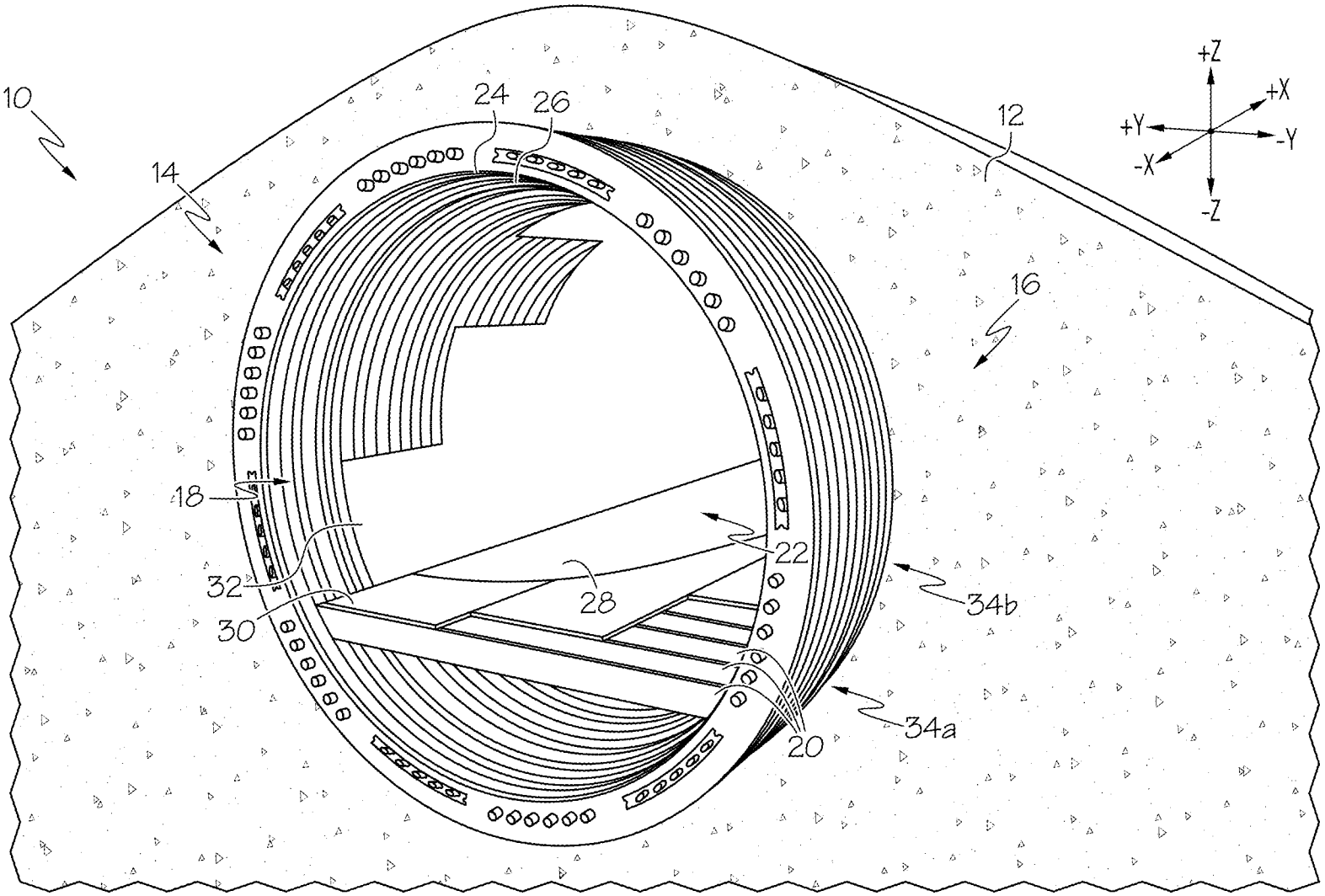
FIG. 1 schematically depicts a perspective environmental view of a building structure partially exposed according to one or more embodiments shown and described herein.
Figure 2:
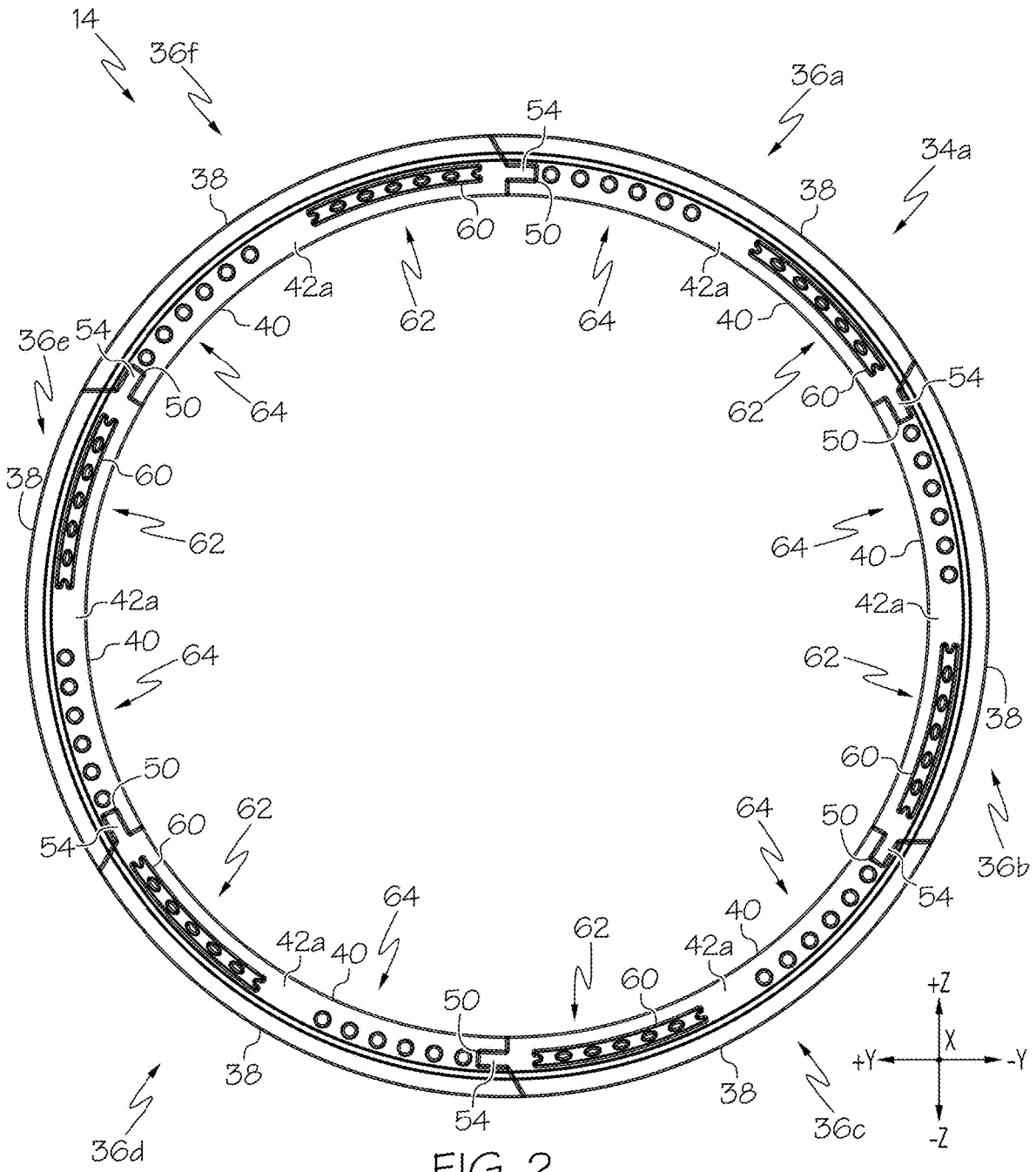
FIG. 2 schematically depicts a front view of an annular segment of the building structure of FIG. 1 according to one or more embodiments shown and described herein.
Figure 3:
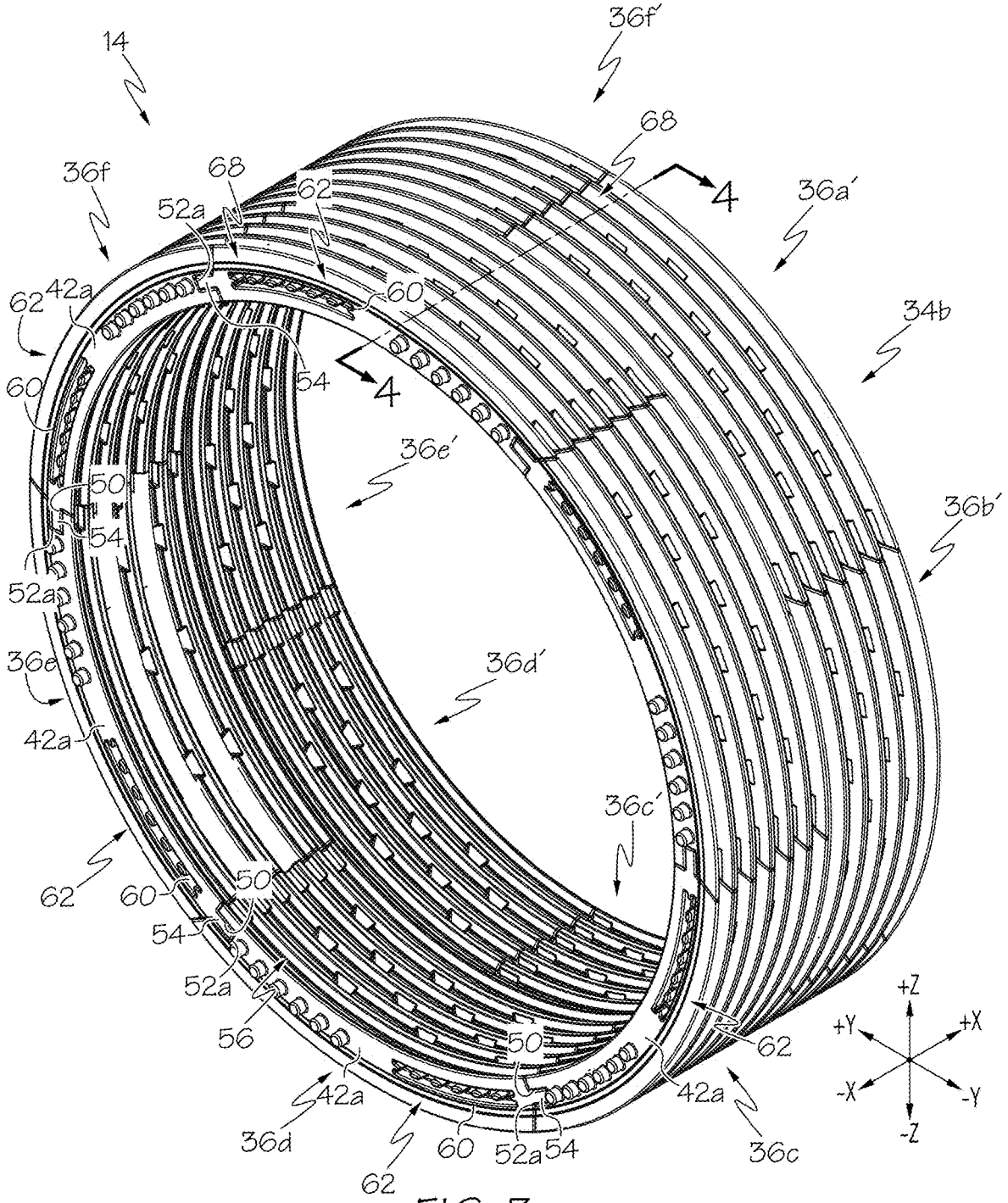
FIG. 3 schematically depicts a perspective view of two adjoined annular segments of the building structure of FIG. 1 according to one or more embodiments shown and described herein.
Figure 4:
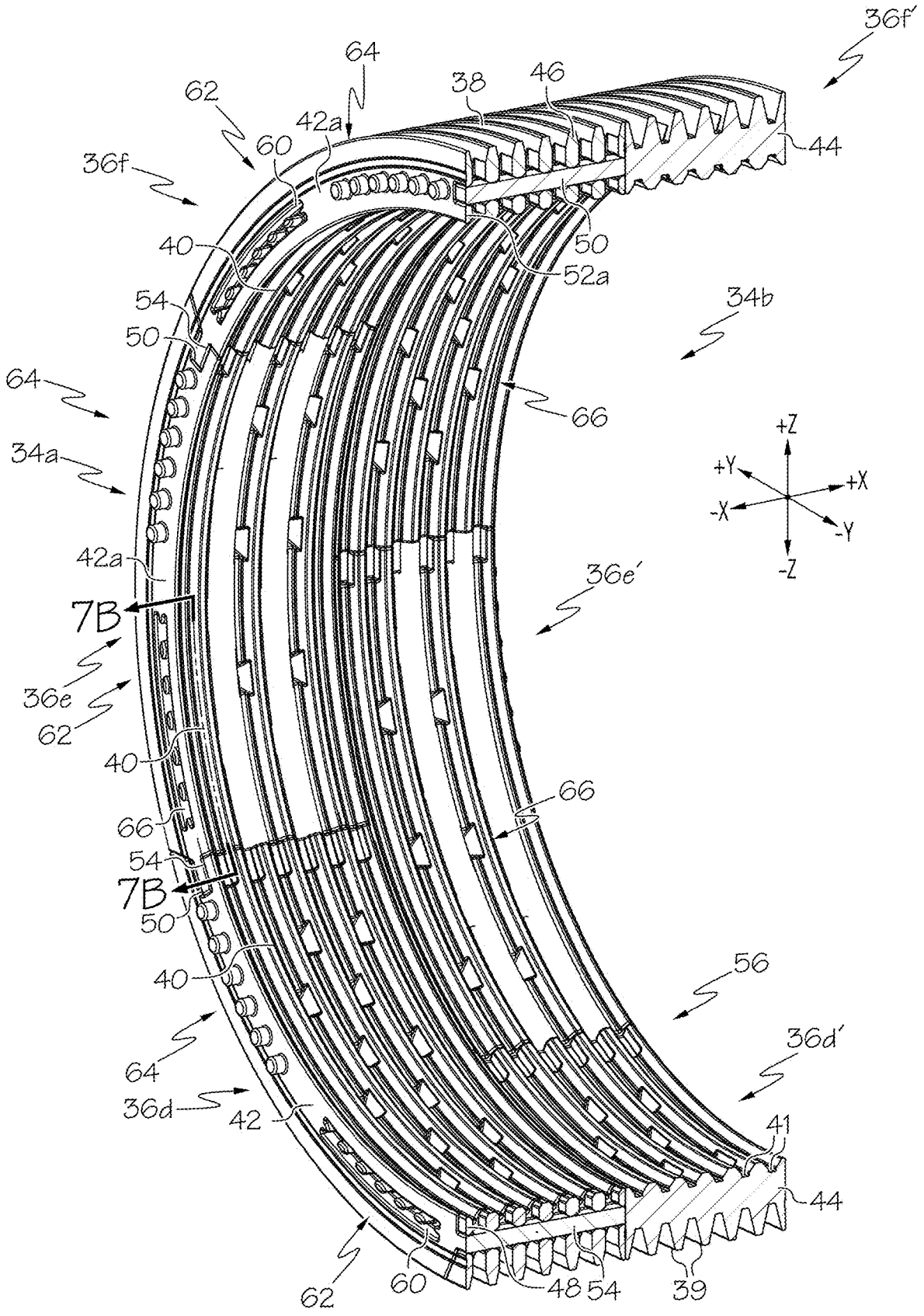
FIG. 4 schematically depicts a perspective cross-sectional view of the two adjoined annular segments of FIG. 3 taken from line 4-4 according to one or more embodiments shown and described herein.
Figure 5B:
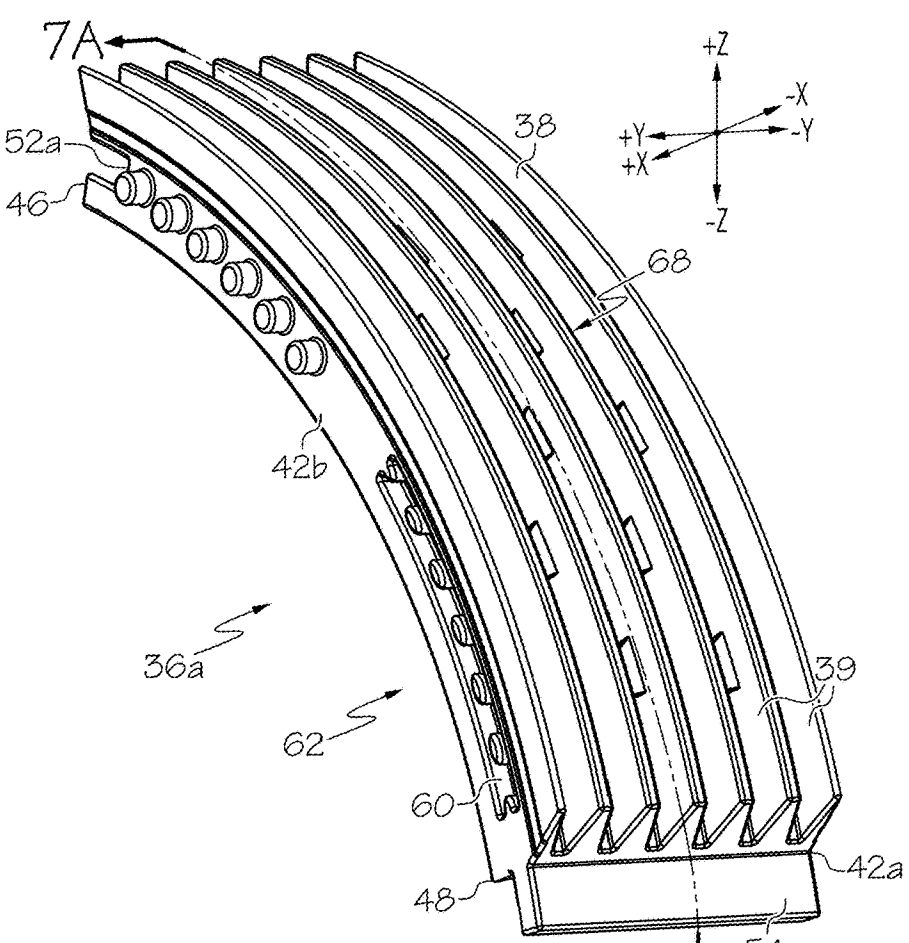
FIG. 5B schematically depicts a perspective exterior view of a building panel of the annular segment of the building structure of FIG. 1 according to one or more embodiments shown and described herein.
Figure 5A:
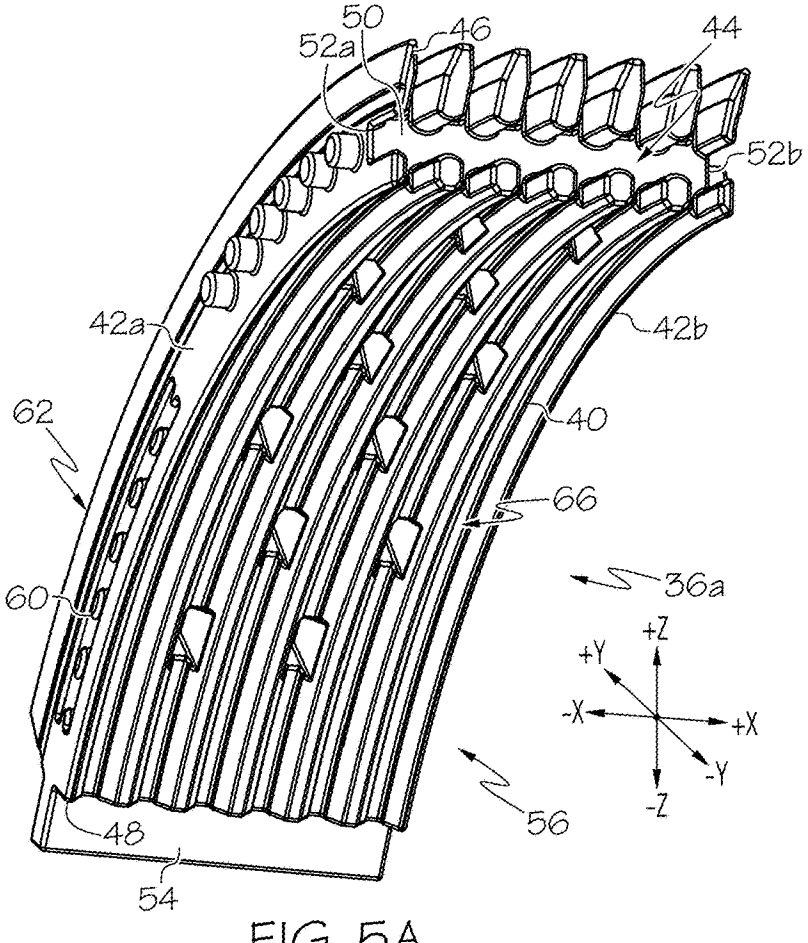
FIG. 5A schematically depicts a perspective interior view of a building panel of the annular segment of the building structure of FIG. 1 according to one or more embodiments shown and described herein.
Figure 6A:
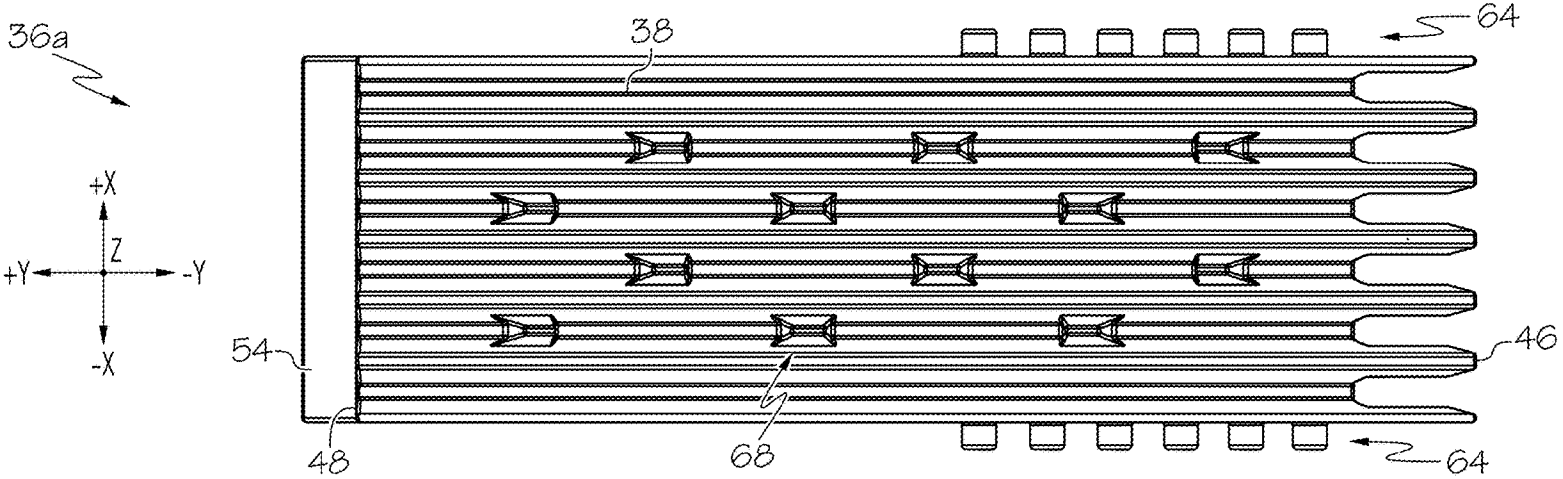
FIG. 6A schematically depicts a top view of a building panel of the annular segment of the building structure of FIG. 1 according to one or more embodiments shown and described herein.
Figure 6B:
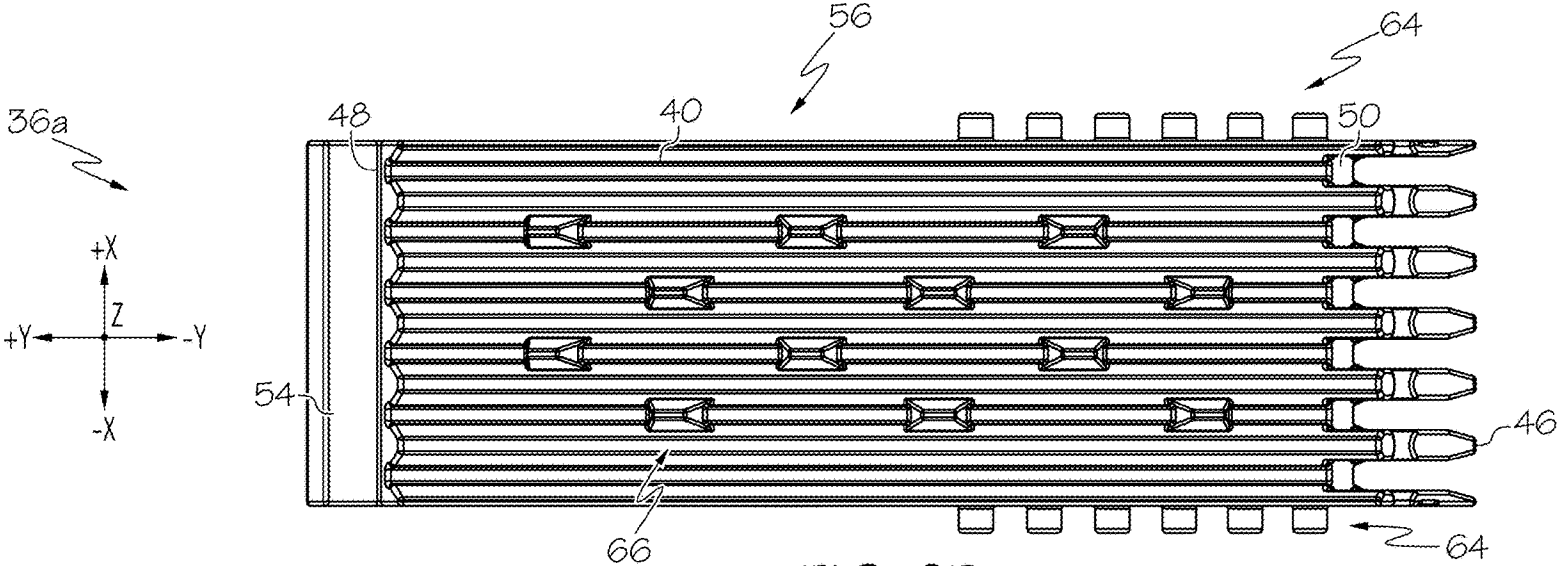
FIG. 6B schematically depicts a bottom view of a building panel of the annular segment of the building structure of FIG. 1 according to one or more embodiments shown and described herein.

As used herein, the term "longitudinal direction" refers to the forward-rearward direction of the building structure (i.e., in the +/−X-direction depicted in FIG. 1). The term "lateral direction" refers to the cross-building structure direction (i.e., in the +/−Y-direction depicted in FIG. 1), and is transverse to the longitudinal direction. The term "vertical direction" or "up" or "above" refer to the upward-downward direction of the building structure (i.e., in the +/−Z-direction depicted in FIG. 1).

Referring now to FIG. 1, a perspective environmental view of a building structure 10 partially exposed from a covering such as an earth 12 is schematically depicted. As illustrated, in some embodiments, the building structure 10 may be partially or fully covered by earth 12. This is non-limiting and the building structure 10 may not be covered by the earth 12 and instead be positioned to rest on the earth 12 or be positioned or suspended above the earth 12 in the vertical direction (i.e., in the +/−Z direction) such as with stilts.

The building structure 10 may be formed with a plurality of building panels 14 and include a specific structure to enable the fitment and connection of a plurality of adjacent panels into an annular segment 34*a* and a plurality of annular segments 34*b* are interconnected from edge-to-edge to form the cohesive tubular structure 16 with a bore 18 extending there through, as discussed in greater detail herein. A plurality of floor joists 20 are positioned along an inner portion 26 of the bore 18 to define a livable space 22 between the floor joists 20 and an apex 24 of the inner portion 26 of the livable space 22 of the tubular structure 16.

Further, as illustrated in FIG. 1, each of the plurality of building panels 14 incorporate the necessary structure to form the livable space 22 and provide comforts that users would be used to having in conventional buildings such as a moisture barrier, air gap, interior finish support system, ventilation ductwork, and interior finishes, as illustrated by the flooring 28 attached to a subfloor 30 coupled to the floor joists 20 and drywall finishing 32.

Now referring to FIGS. 1-9B, as discussed in greater detail herein, each of the plurality of building panels 14 are generally arcuate in shape with a predetermined continuous arc at predetermined degrees depending on a desired diameter of the building structure 10. It should be understood that each of the plurality of building panels 14 may be any predetermined angle of degrees that once interconnected form 360 degrees. For example, in some embodiments, each of the plurality of building panels 14 may have a predetermined angle of 60 degrees, which requires six of the plurality of building panels 14 to be interconnected to form the annular segment 34*a* and an additional six of the plurality of building panels 14 to form additional adjacent annular segments, such as annular segment 34*b*, that once affixed together, form the tubular structure 16. In other embodiments, each of the plurality of building panels 14 may have a predetermined angle of 30 degrees, 40 degree, 80 degrees, 90 degrees, and so on, to form the annular segment 34*a* and adjacent annular segments such as angular segment 34*b*, that once affixed together, form the tubular structure 16. In some embodiments, each of the plurality of building panels 14 have the same predetermined angle (e.g., when each panel is 90 degrees, four building panels would be required to form the continuous 360 degrees).

Referring now to FIGS. 2-4, 5A-5B and 6A-6B, the annular segment 34*a* is formed by the interconnection of a plurality of building panels 14. Each building panel 36*a*-36*f* of the annular segment 34*a* (and additional adjacent annular segments such as annular segment 34*b*) includes an exterior wall portion 38, an interior wall portion 40 and a pair of opposing sidewalls 42*a*, 42*b*. The pair of opposing sidewalls 42*a*, 42*b* space apart the interior wall portion 40 from the exterior wall portion 38 to define a cavity 44 therebetween. For brevity reasons, only building panel 36*a* is described in further detail and is illustrated in FIGS. 5A-5B and 6A-6B. It should be understood that each of the building panel 36*a*-36*f* of the annular segment 34*a* (and additional building panels 36*a*'-36*f*' that form additional annular segments such as annular segment 34*b*) are identical.

Figure 9A:
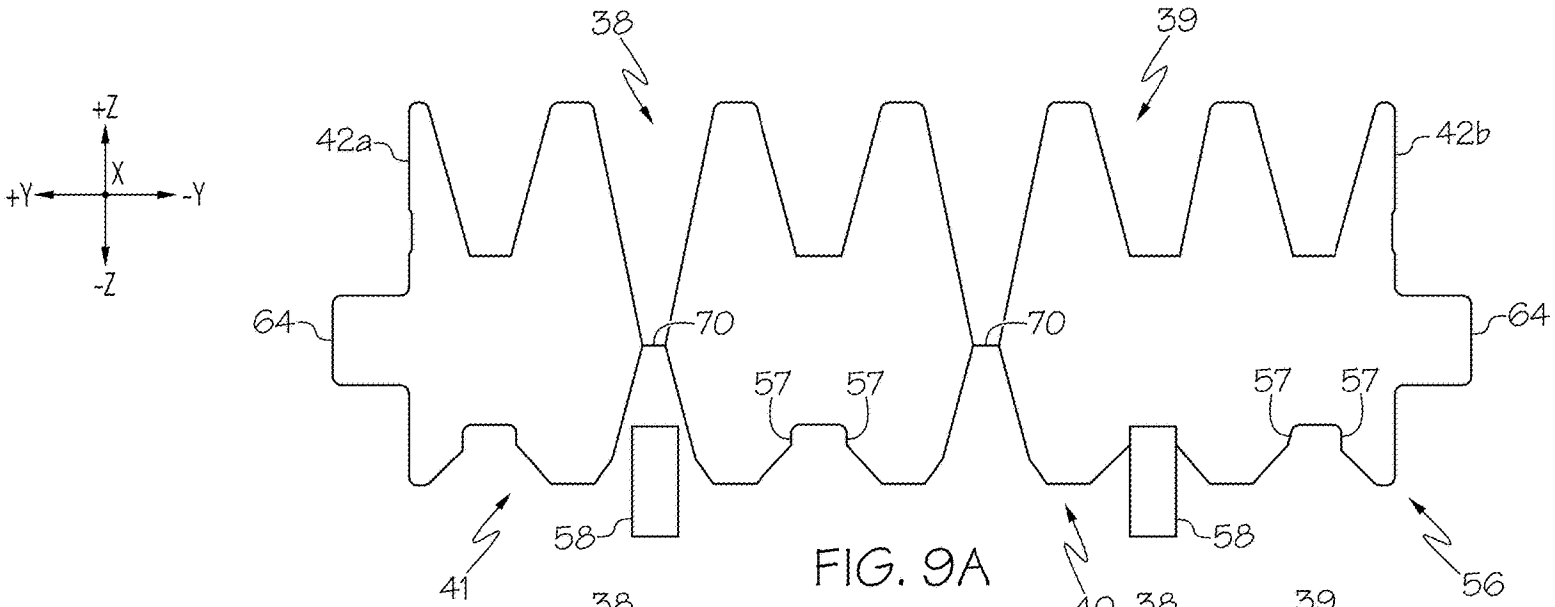
FIG. 9A schematically depicts a partial cross-sectional view illustrating a corrugation of an exterior wall portion and an interior wall portion and a junction of a plurality of rigid members of the building panel of FIG. 5B according to one or more embodiments shown and described herein.

The exterior wall portion 38 of the building panel 36*a* is aligned with an exterior of the building structure 10 (FIG. 1) and generally is the exterior most feature of the building panel 36*a*. The exterior wall portion 38 is corrugated 39, as best illustrated in FIG. 9A to increase the overall strength of the building panel 36*a* to form a strong and durable structural shell capable of supporting and distributing structural loads.

Figure 9B:
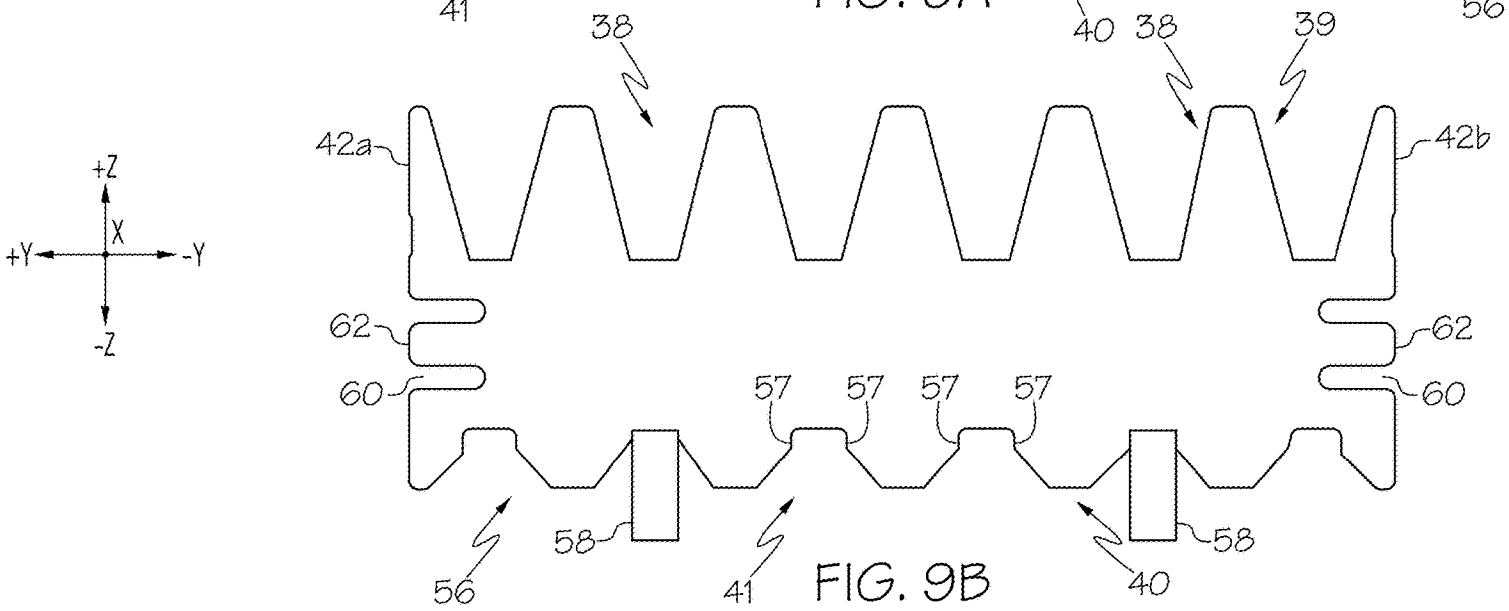
FIG. 9B schematically depicts a partial cross-sectional view illustrating the corrugation of the exterior wall portion and the interior wall portion and a stick member of the building panel of FIG. 9A according to one or more embodiments shown and described herein.

The interior wall portion 40 of the building panel 36*a* may be generally aligned with the inner portion 26 of the livable space 22 of the tubular structure 16. The interior wall portion 40 may generally be used for the attachment of finish materials to complete the structure. As such, the interior wall portion 40 is corrugated 41 to increase strength. The corrugation 41 of the interior wall portion 40 is less prominent than the corrugation 39 of the exterior wall portion 38 so as to enable the fastening of finish materials, as best illustrated in FIGS. 9A-9B. Further, the corrugation 41 of the interior wall portion 40 includes a plurality of channels 56. The plurality of channels 56 have a predetermined size and shape to be configured to receive a stick member 58, such as, but not limited to, traditional framing materials like wood studs, engineered wood studs, composite studs, structural steel, or other similar materials for the purpose of acting as a nailer to enable the fastening of finish materials for building out the livable space 22. Further, each of the plurality of channels 56 include radiused corner portions 57 at the innermost portion. In some embodiments, the radiused corner portions 57 on an inside corner may be between 25% to 75% of the nominal wall thickness. It should be appreciated that this is non-limiting and the radiused corner portions 57 on the inside corner may be more than 75% or less than 25% of the nominal wall thickness. The radiused corner portions 57 distribute the corner stress over a broader area thus adding to the strength of the interior wall portion 40 and improve the molding process, as discussed in greater detail herein.

To accommodate traditional building and framing conventions, each of the plurality of channels 56 may be spaced sixteen (16) inches on center. In some embodiments, each of the plurality of channels 56 has a shape, such as, but not limited to a keystone shape, so as to enable the coupling of the stick member 58 into the channel without the need for additional fasteners. Accordingly, the material selected for the building panel 36*a* has some resilience or flexion to allow for this coupling without fasteners.

The building panel 36*a* includes a first end portion 46 and an opposite second end portion 48. In some embodiments, the first end portion 46 may include angled portions 47 that are angled with respect to the other portions of the first end portion 46 and the second end portion 48 may include angled portions 49 that are angled with respect to the other portions of the second end portion 48. In some embodiments, the angled portions 47, 49 are positioned on the exterior wall portion 38. In other embodiments, the angled portions 47, 49 may be included on the interior wall portion 40 or a combination of the interior wall portion 40 and the exterior wall portion 38.

The cavity 44 extends a length of the building panel 36*a* and may be exposed at either the first end portion 46 and/or the second end portion 48 of the building panel 36*a* until an adjacent building panel, such as building panel 36*b* and/or 36*f* is coupled to the building panel 36*a*, as discussed in greater detail herein. In some embodiments, when the building structure 10 may be partially or fully covered by earth 12 (e.g., the building structure 10 of FIG. 1), the cavity 44 remains unfilled and hollow. In other embodiments, when the building structure 10 is positioned on the earth 12 (FIG. 1) or above the earth 12 (FIG. 1) in the vertical direction (i.e., in the +/−Z direction), the cavity 44 may be filled with an insulating material, such as and without limitation, foam, polymer, glass, wool, fiberglass, and/or the like.

Still referring to FIGS. 1-9B, a slip lock slot 50 may be positioned at the first end portion 46 between the pair of opposing sidewalls 42*a*, 42*b* such that each of the pair of opposing sidewalls 42*a*, 42*b* include an opening 52*a*, 52*b*, respectively. The second end portion 48 includes a slip lock tab member 54 that extends from the second end portion 48 and between the pair of opposing sidewalls 42*a*, 42*b*. The slip lock tab member 54 has a thickness that is less than the spacing between the cavity 44, the exterior wall portion 38, and the interior wall portion 40. Further, the slip lock tab member 54 may be configured to geometrically be received within the slip lock slot 50 of an adjoining or adjacent building panel such as building panel 36*f*.

For example, the slip lock slot 50 of the building panel 36*a* is configured to receive the slip lock tab member 54 of the building panel 36*b*, and so on, to create the annular segment 34*a*. In embodiments, the slip lock tab member 54 enters into the slip lock slot 50 from either the pair of openings 52*a*, 52*b* to slidably engage with the slip lock slot 50. As such, the annular segment 34*a* is formed by the building panels 36*a*-36*f* continuous connected from end-to-end. Further, the additional annular segments, such as the annular segment 34*b*, is formed by the building panels 36*a*'-36*f*' continuous connected from end-to-end.

As such, embodiments disclosed herein enable the interconnection of adjacent panels within the annular segment 34*a*, additional annular segments, such as annular segment 34*b*, and so on, without the need for additional fasteners, but instead utilizes press-fit, interference fit, or friction fit connections to form the each of the annular segments 34*a*, 34*b*, and so on.

In some embodiments, the connection of the first end portion 46 and the second end portion 48 may include an additional channel or trough having a size to receive a gasket member. The gasket member may generally be a resilient material configured to prevent the infiltration of moisture to the interior space.

Each of the pair of opposing sidewalls 42*a*, 42*b* further include a recess portion 60 positioned adjacent to the second end portion 48. A plurality of receiving connectors 62 are positioned within the recess portion 60. In some embodiments, each of the plurality of receiving connectors 62 may be elliptical in shape. In other embodiments, each of the plurality of receiving connectors 62 may be other shapes such as circular, square, hexagonal, octagonal, rectangular, and/or the like. In some embodiments, each of the plurality of receiving connectors 62 may be uniformly spaced apart. In other embodiments, each of the plurality of receiving connectors 62 may be irregularly spaced apart.

Each of the pair of opposing sidewalls 42*a*, 42*b* further include a plurality of protrusions 64 extending from the respective sidewall of the pair of opposing sidewalls 42*a*, 42*b*. In some embodiments, each of the plurality of protrusions 64 may be circular in shape. In other embodiments, each of the plurality of protrusions 64 may be other shapes such as elliptical, square, hexagonal, octagonal, rectangular, and/or the like. In some embodiments, each of the plurality of protrusions 64 may be uniformly spaced apart. In other embodiments, each of the plurality of protrusions 64 may be irregularly spaced apart.

The spacing of the plurality of protrusions 64 corresponds to the spacing of the plurality of receiving connectors 62 such that plurality of protrusions 64 of the adjacent building panels of the annular segment 34*b* are received in the spacing between the plurality of receiving connectors 62 of the adjacent building panels of the annular segment 34*a* to affix or couple adjacent annular structures such as annular segment 34*a* to annular segments 34*b* and so on.

That is, the plurality of receiving connectors 62 and the plurality of protrusions 64 are generally configured to enable the joining of adjacent panels during assembly, wherein an adjacent building panel can be press-fit into place without the need for additional fasteners. As such, this configuration may allow the last building panel of an adjacent annular segment, such as angular segment 34*b* to be placed without bending the other adjacent building panels 36*a*-36*f* of the annular segment 34*a* while permitting for the structural integrity required.

Still Referring to FIGS. 1-9B, in some embodiments, a plurality of rigid members 66, 68 extend through the cavity 44 and from the interior wall portion 40 and the exterior wall portion 38, respectively, to couple to one another at a junction 70. That is, the interior wall portion 40 and the exterior wall portion 38 are coupled together via the pair of opposing sidewalls 42*a*, 42*b* and the plurality of rigid members 66, 68. Each of the plurality of rigid members 66, 68 may include ribbing.

Figure 7A:
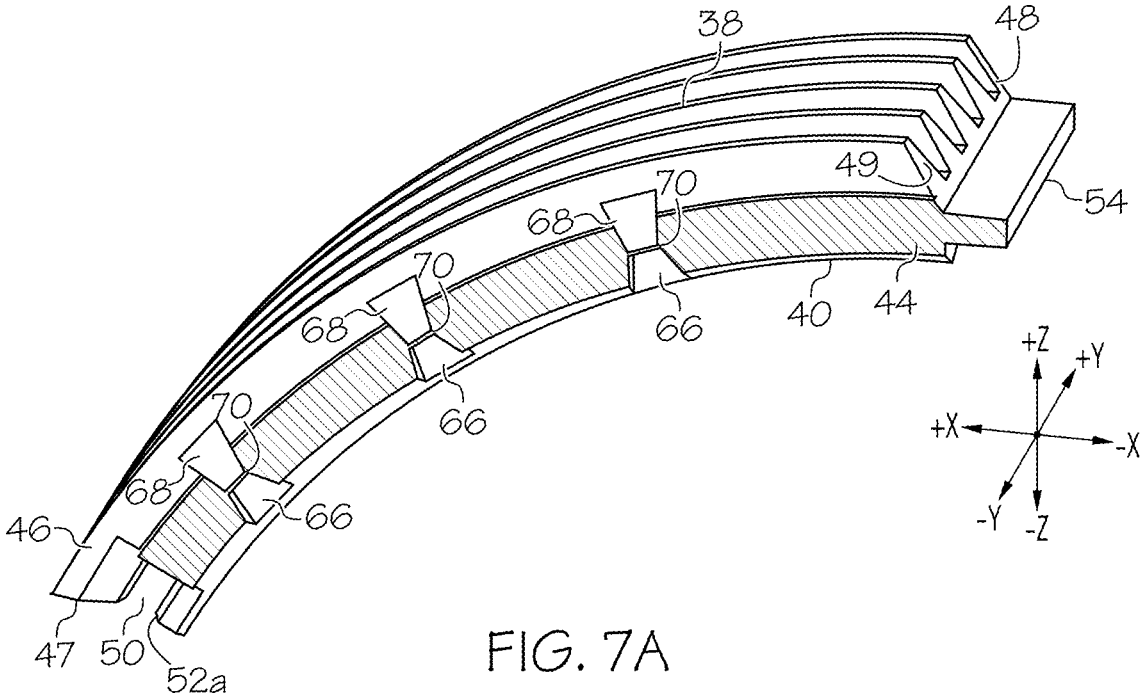
FIG. 7A schematically depicts a cross-sectional view of the building panel of FIG. 5B taken from line 7A-7A according to one or more embodiments shown and described herein.
Figure 7B:
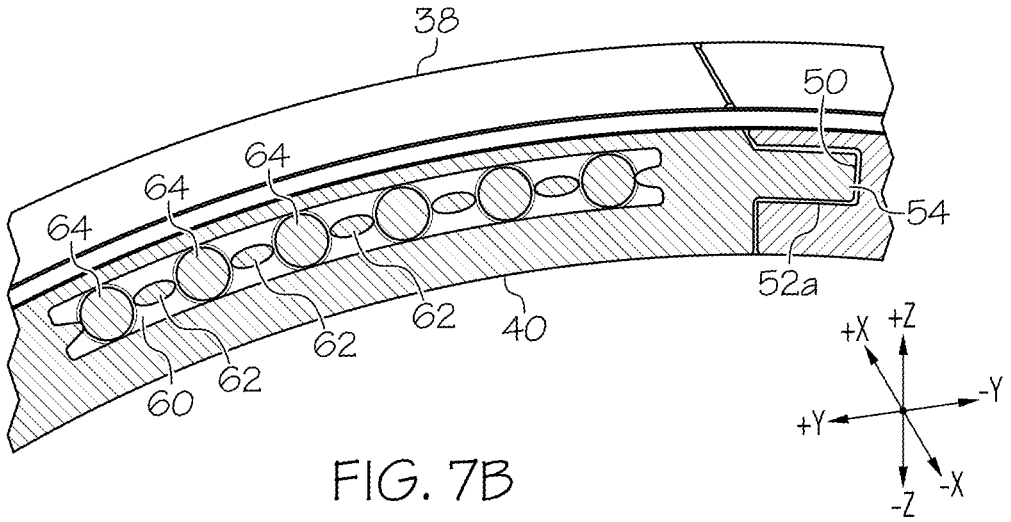
FIG. 7B schematically depicts a cross-sectional view of the building panels of FIG. 4 taken from line 7B-7B according to one or more embodiments shown and described herein.
Figure 8A:
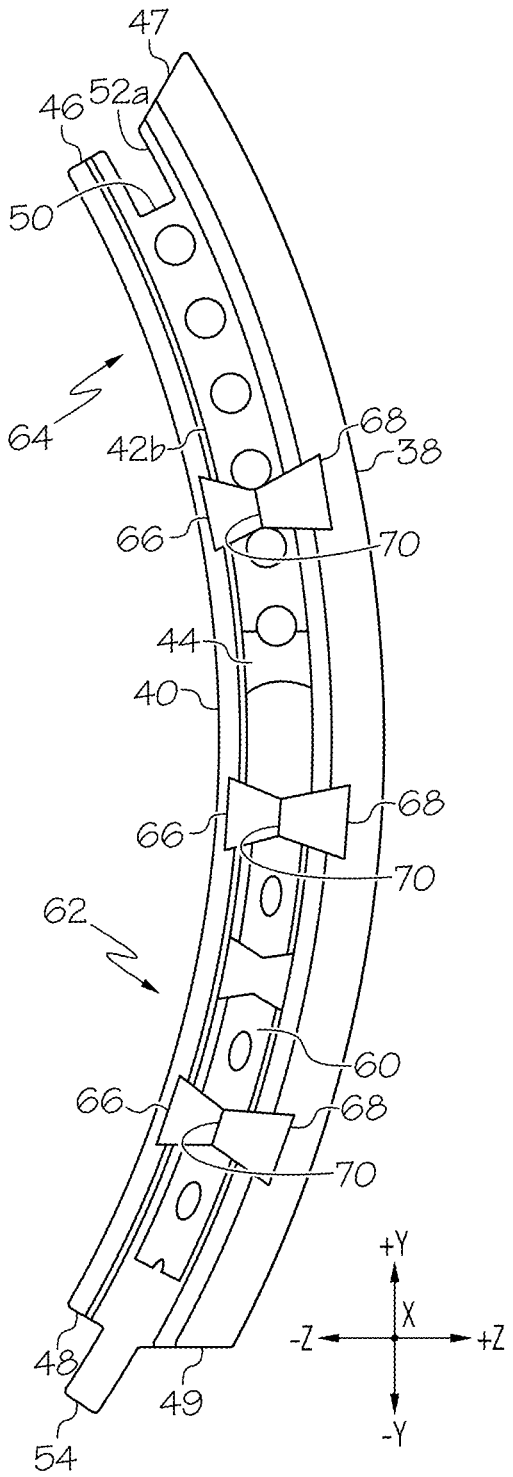
FIG. 8A schematically depicts an isolated cross-sectional view of a cavity and the plurality of rigid members of the building panel of FIG. 5B taken from line 7A-7A according to one or more embodiments shown and described herein.
Figure 8B:
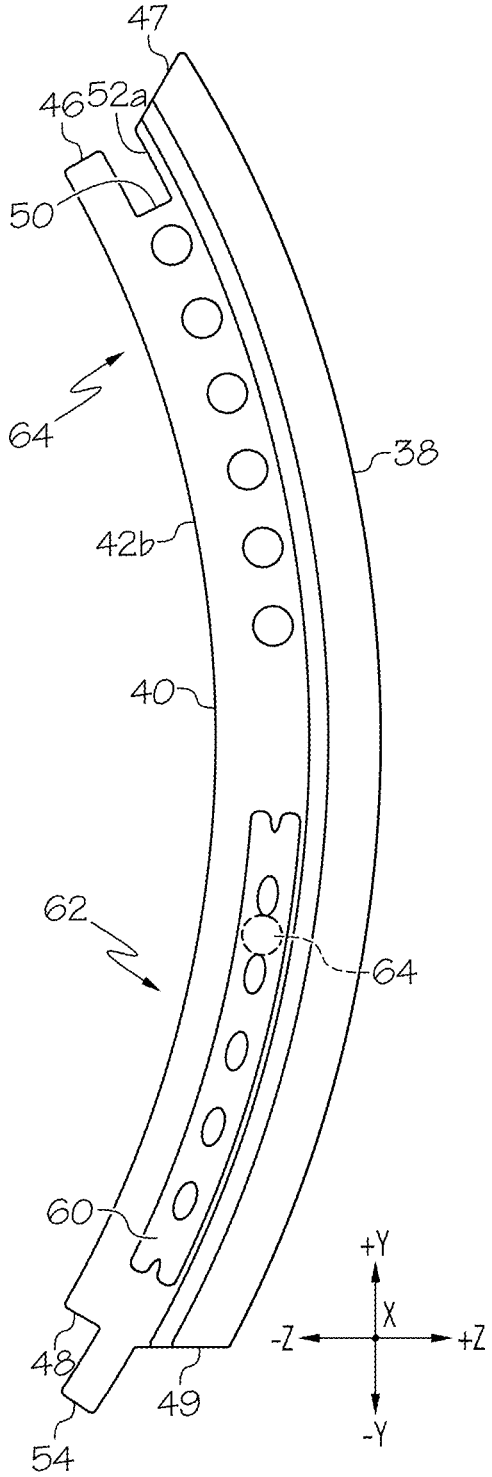
FIG. 8B schematically depicts a side view of the building panel of FIG. 5B according to one or more embodiments shown and described herein.

The junction 70 connecting or coupling the plurality of rigid members 66, 68 may be positioned within the cavity 44, as best illustrated in FIG. 7A. The plurality of rigid members 66, 68 coupled together at the junction 70 increase the overall strength of the building panel 36*a*. That is, the plurality of rigid members 66, 68 may be used to provide strength and dimensional stability to counteract warpage. In some embodiments, the plurality of rigid members 66, 68 each have a greater wall thickness than the interior wall portion 40 and/or the exterior wall portion 38. For example, the thickness of the plurality of rigid members 66, 68 may be 175 percent of the nominal wall thickness. It should be appreciated that this is merely an example and that the thickness of the plurality of rigid members 66, 68 may be more than or less than 175 percent of the nominal wall thickness.

The building panel 36*a* may utilize a variety of material thicknesses and corrugation depth (both the interior wall portion 40 and exterior wall portion 38) dependent upon the finished radius of the assembled tubular shape. Further, the building panel 36*a* may be formed from a variety of different materials including low density polyethylene (LDPE), Linear Low Density Polyethylene (LLDPE), Medium Density Polyethylene (MDPE), High Density Polyethylene (HDPE), cross-linked polyethylene (XLPE), polypropylene (PP), polycarbonate (PC), nylon, plastisols, combinations thereof, and/or the like.

Figure 10:
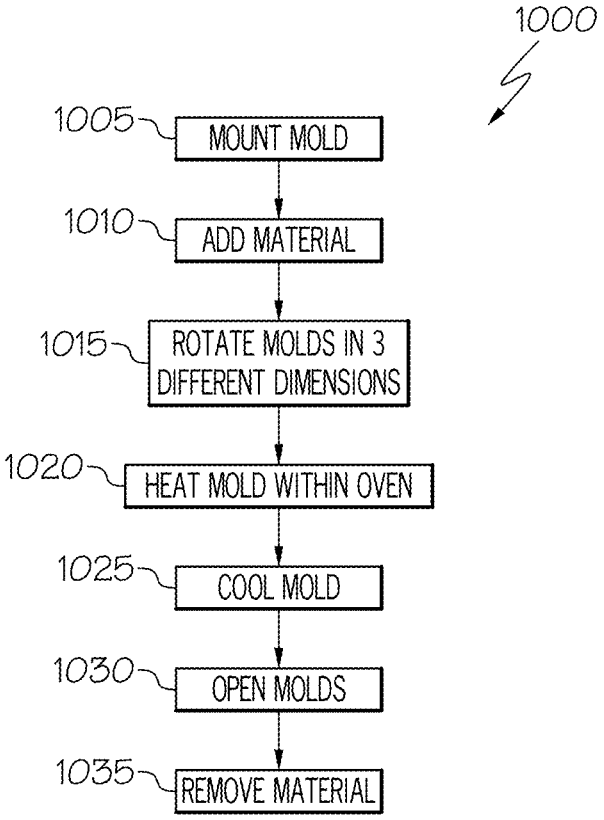
FIG. 10 schematically depicts an illustrative method for forming the building panel according to one or more embodiments shown and described herein.

Referring now to FIG. 10, in which FIG. 10 illustrates a flow diagram that graphically depicts an illustrative method 1000 for forming the building panel is provided. Although the steps associated with the blocks of FIG. 10 will be described as being separate tasks, in other embodiments, the blocks may be combined or omitted. Further, while the steps associated with the blocks of FIG. 10 will be described as being performed in a particular order, in other embodiments, the steps may be performed in a different order.

At block 1005, the mold is mounted within a rotational molding machine also known as rotomolding, rotomold, and rotocasting. At block 1010, a material is added to the mold. The material may be liquid or powder. Example material may include, without limitation, LDPE, LLDPE, MDPE, HDPE, XLPE, PP, PC, and/or the like. The mold is rotated in three different dimensions, at block 1015. At block 1020, the mold is heated within an oven. At block 1025, the mold is cooled and, at block 1030, the mold is opened and the building panel is removed from the mold at block 1035. Such a process creates parts that are extremely durable. Further, it should be appreciated that to form the building panels, the molds are formed with certain angles and curved surfaces, such as the radiused corner portions 57, the angled portions 47, 49, and/or the like assist in the dimensional stability, durability and strength of the building panel as well as for removal from the mold.

Figure 11:
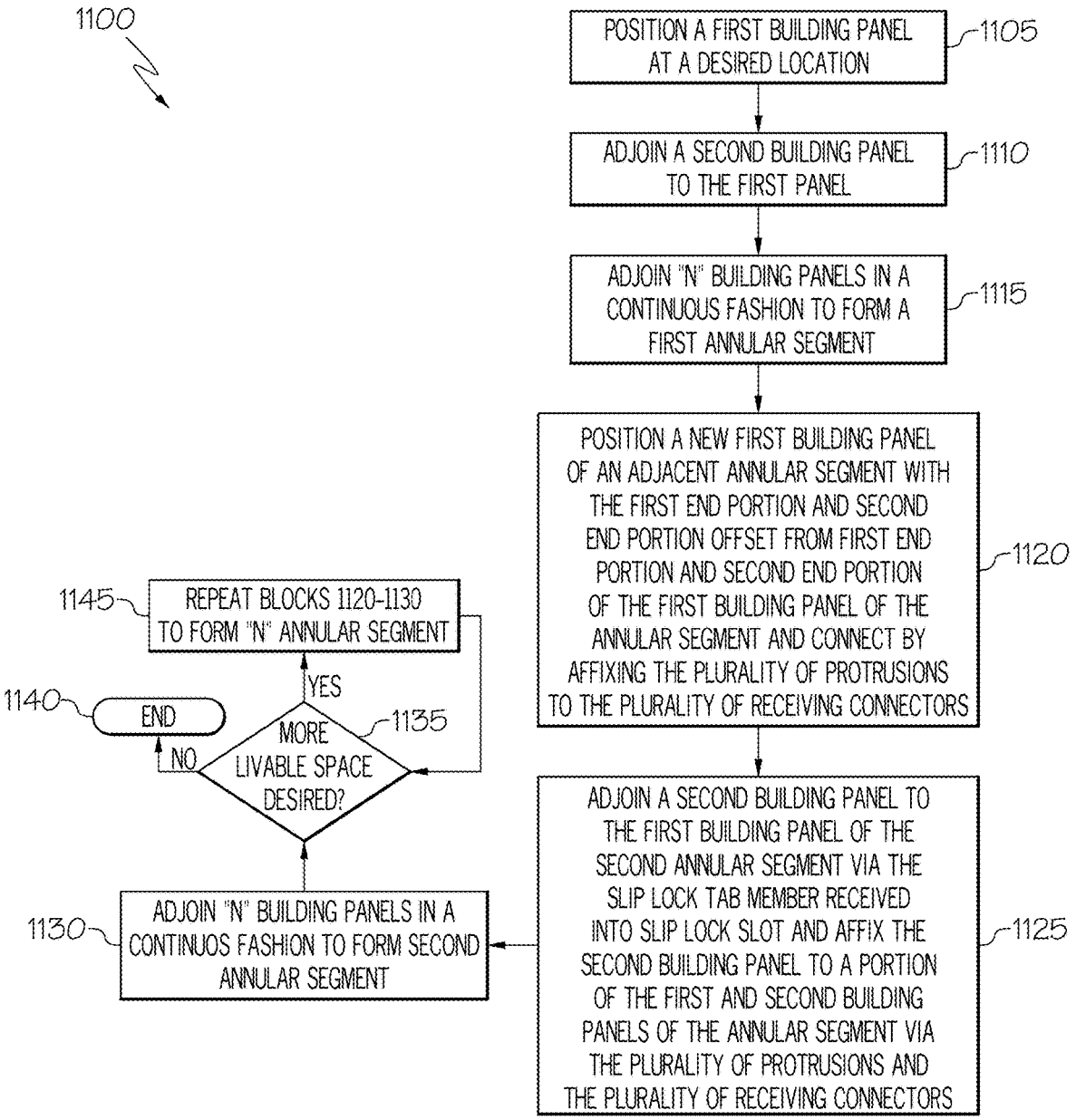
FIG. 11 schematically depicts an illustrative method for assembling the annular segments to form the cohesive tubular structure according to one or more embodiments shown and described herein.

Referring now to FIG. 11, in which FIG. 11 illustrates a flow diagram that graphically depicts an illustrative method 1100 for assembling the annular segments to form the cohesive tubular structure is provided. Although the steps associated with the blocks of FIG. 11 will be described as being separate tasks, in other embodiments, the blocks may be combined or omitted. Further, while the steps associated with the blocks of FIG. 11 will described as being performed in a particular order, in other embodiments, the steps may be performed in a different order.

At block 1105, a first building panel is positioned at a desired location. In some embodiments, the desired location may be positioned within or below an earth surface. In other embodiments, the desired location may be on the earth surface or above the earth surface such as on stilts. At block 1110, a second building panel is adjoined to the first building panel. The adjoining is from an end-to-end arrangement. That is, the slip lock tab member of the first building panel is received in a slip lock slot of the second building panel. It should be appreciated that the slip lock tab member of the first building panel is inserted into the slip lock slot of the second building panel through one of the openings in the lateral direction (i.e., +/−Y direction).

At block 1115, "N" building panels are adjoined in a continuous fashion to form a first annular segment. In some embodiments, "N" building panels are an additional four panels to form the first annular segment. In other embodiments, when the inner diameter of the living space is larger or smaller than that as illustrated, "N" building panels may be more or less than the six building panels as illustrated. As such, each annular segment is the plurality of building panels adjoined end-to-end.

In some embodiments, "N" building panels are an additional four panels to form the first annular segment. In other embodiments, when the inner diameter of the living space is larger or smaller than that as illustrated, "N" building panels may be more or less than the six building panels as illustrated. As such, each annular segment is the plurality of building panels adjoined end-to-end.

At block 1120, a new first building panel of a second and adjacent annular segment is positioned with the first end portion and the second end portion offset from the first end portion and the second end portion of the first building panel of the annular segment and connected to the first building panel of the annular segment by the plurality of protrusions received by the plurality of receiving connectors to affix the new first building panel of an adjacent annular segment to the first building panel of the annular segment.

At block 1125, a new second building panel of the second annular segment is adjoined to the first building panel of the second annular segment via the slip lock tab member of the first building panel is received in a slip lock slot of the second building panel and the new second building panel of the second annular segment is affixed to the a portion of the first and second building panels of the annular segment via the plurality of protrusions received by the plurality of receiving connectors. That is, the building panels of the second annular segment are offset or rotated with respect to the building panel of the annular ring so to distribute load and overlap seams.

At block 1130, "N" building panels are adjoined in a continuous fashion to form the second annular segment. At block 1135, a determination is made whether more livable space is desired. If no more livable space is desired, at block 1135, then the assembly process ends, at block 1140. If more livable space is desired, at block 1135, then art block 1145, "N" additional annular segments are required by repeating blocks 1120-1130.

As such, it should be understood that multiple building panels are adjoined edge-to-edge to form the annular segment with additional building panels utilized to form successive annular segments that are assembled end-to-end with each successive annular segment affixed or coupled to the previous annular segment via the plurality of protrusions received by the plurality of receiving connectors to form a continuous and cohesive tubular structure.

The final tubular structure has a circumference that is generally formed from the attachment of six building panels, as illustrated. However, this is non-limiting and more than or less than six panels with differing degrees of angle may be used. The tubular structure may be supported without the need for foundational elements and can easily be placed directly on the earth surface and/or covered with earth.

It should be appreciated that this arrangement may allow for an even distribution of weight and load across the building panels **36*a*-36*f* and further facilitates an assembly method that alters the position of adjacent building panels 36*a*'-36*f*' relative to each other to strengthen the assembled structure. Accordingly, in assembly, building panels 36*a*'-36*f*' are assembled in adjacency by overlapping the seamed connection to the building panels 36*a*-36*f*** such that the seams between building panels are staggered relative to each other. Such an arrangement continues for "N" annular segments and "N" building panels.

It should now be understood that the embodiments described herein are directed to improve building panels used in constructing a cohesive tubular structure that forms a livable space. The building panels described herein are generally arcuate in shape and include a specific structure to enable the fitment and connection of a plurality of adjacent panels into the cohesive tubular structure with a bore extending there through that defines the livable space. Each of the building panels are generally a corrugated hollow body. To form the cohesive tubular structure, the slip lock slot of one building panel is configured to receive the slip lock tab member of an adjacent building panel and so on to form an annular segment. Additional building panels are used to form an infinite number of additional annular segments. Each additional annular segment is affixed or coupled to the annular segment together with the seams in an offset manner to define the tubular structure. As such, the building panels couple to one another in an end-to-end fashion and couple to adjacent panels in an edge-to-edge fashion.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A building panel comprising:

an exterior wall portion opposite an interior wall portion by a pair of opposing sidewalls that are connected to the exterior wall portion and the interior wall portion to define a cavity between the exterior wall portion and the interior wall portion, the interior wall portion and the pair of opposing sidewalls are arcuate in shape to define the building panel, a plurality of first members extend from an inner surface of the interior wall portion within the cavity;

a plurality of second members extend from an inner surface of the exterior wall portion within the cavity, each of the plurality of first members couple to a corresponding one of the plurality of second members within the cavity; and a first end portion and opposite second end portion arranged such that the building panel is configured to adjoin the first end portion of the building panel to the second end portion of a second building panel in a continuous fashion to define a tubular structure.

2. The building panel of claim 1, wherein each of the plurality of first members or the plurality of second members include a ribbing.

3. The building panel of claim 1, further comprising:

a plurality of floor joists extending within the tubular structure between the interior wall portion of the building panel defining a space between the plurality of floor joists and an apex of the tubular structure.

4. The building panel of claim 3, further comprising:

a flooring coupled to the plurality of floor joists to extend within the tubular structure with the plurality of floor joists.

5. The building panel of claim 3, further comprising:

a recess portion having a plurality of receiving connectors extending therein and positioned on each of the pair of opposing sidewalls; and a plurality of protrusions extending from each of the pair of opposing sidewalls, wherein the recess portion and the plurality of receiving connectors of the building panel engages with the plurality of protrusions of another building panel defining a second annular segment arranged to extend in a longitudinal direction from the building panel.

6. The building panel of claim 5, wherein each of the plurality of protrusions are circular in shape and each of the plurality of receiving connectors are elliptical in shape.

7. The building panel of claim 1, wherein the exterior wall portion has an exterior surface that is corrugated in shape.

8. The building panel of claim 1, wherein the interior wall portion has an interior surface that is corrugated in shape.

9. A tubular structure comprising:

a plurality of building panels interlocked to form an annular segment, each of the plurality of building panels having:

an exterior wall portion opposite an interior wall portion by a pair of opposing sidewalls that are connected to the exterior wall portion and the interior wall portion to define a cavity between the exterior wall portion and the interior wall portion, the exterior wall portion, the interior wall portion and the pair of opposing sidewalls are arcuate in shape to define each of the plurality of building panels;

a plurality of first members extend from an inner surface of the interior wall portion within the cavity;

a plurality of second members extend from an inner surface of the exterior wall portion within the cavity, each of the plurality of first members couple to a corresponding one of the plurality of second members within the cavity; and a first end portion and opposite second end portion arranged such that each of the plurality of building panels are configured to adjoin the plurality of building panels in a continuous fashion to define the annular segment of the tubular structure.

10. The tubular structure of claim 9, wherein each of the plurality of first members or the plurality of second members include a ribbing.

11. The tubular structure of claim 9, wherein the plurality of building panels further comprise:

a recess portion having a plurality of receiving connectors extending therein and positioned on each of the pair of opposing sidewalls; and a plurality of protrusions extending from each of the pair of opposing sidewalls, wherein the recess portion and the plurality of receiving connectors of each of the plurality of building panels engage with the plurality of protrusions of other building panels of the plurality of building panels defining a second annular segment arranged to extend in a longitudinal direction from the annular segment.

12. The tubular structure of claim 11, wherein the plurality of receiving connectors are elliptical in shape.

13. The tubular structure of claim 12, wherein the plurality of protrusions are circular in shape.

14. The tubular structure of claim 11, further comprising:

a plurality of floor joists extending between the interior wall portions of the plurality of building panels defining the annular segment and the plurality of building panels defining the second annular segment, the plurality of floor joists defining a space between the plurality of floor joists and an apex of the tubular structure.

15. The tubular structure of claim 14, further comprising:

a flooring coupled to the plurality of floor joists to extend within the tubular structure with the plurality of floor joists.

16. The tubular structure of claim 9, wherein the exterior wall portion has an exterior surface that is corrugated in shape.

17. The tubular structure of claim 9, wherein the interior wall portion has an interior surface that is corrugated in shape.

18. A building structure comprising:

a first plurality of arcuate building panels interlocked to form a first annular segment, each of the first plurality of arcuate building panels including:

an exterior wall portion opposite an interior wall portion by a pair of opposing sidewalls that are connected to the exterior wall portion and the interior wall portion to define a cavity between the exterior wall portion and the interior wall portion, the exterior wall portion, the interior wall portion and the pair of opposing sidewalls are arcuate in shape to define each of the first plurality of arcuate building panels;

a plurality of first members extend from an inner surface of the interior wall portion within the cavity;

a plurality of second members extend from an inner surface of the exterior wall portion within the cavity, each of the plurality of first members couple to a corresponding one of the plurality of second members within the cavity; and a first end portion and opposite second end portion arranged such that each of the first plurality of arcuate building panels are configured to adjoin the first plurality of arcuate building panels in a continuous fashion to define the first annular segment;

a second plurality of arcuate building panels forming a second annular segment, each of the second plurality of arcuate building panels including:

a second exterior wall portion opposite a second interior wall portion by a second pair of opposing sidewalls that are connected to the second exterior wall portion and the second interior wall portion to define a second cavity between the second exterior wall portion and the second interior wall portion, the second exterior wall portion, the second interior wall portion and the second pair of opposing sidewalls are arcuate in shape to define each of the second plurality of arcuate building panels;

a plurality of third members extend from an inner surface of the second interior wall portion within the second cavity;

a plurality of fourth members extend from an inner surface of the second exterior wall portion within the second cavity, each of plurality of third members couple to a corresponding one of the plurality of fourth members within the second cavity; and a third end portion and opposite fourth end portion of the second plurality of arcuate building panels arranged such that each of the second plurality of arcuate building panels are configured to adjoin the second plurality of arcuate building panels in a continuous fashion to define the second annular segment, wherein:

the first annular segment and the second annular segment are interconnected to define a tubular structure with a bore extending there through; and a plurality of floor joists extending within the bore of the tubular structure between the interior wall portion and the second interior wall portion, the plurality of floor joists having a floor coupled thereon to define a space between the floor and an apex of the tubular structure.

19. The building structure of claim 18, wherein each of the first plurality of arcuate building panels further comprising:

a recess portion having a plurality of receiving connectors extending therein and positioned on each of the pair of opposing sidewalls; and a plurality of protrusions extending from each of the pair of opposing sidewalls.

20. The building structure of claim 19, wherein each of the second plurality of arcuate building panels further comprising:

a second recess portion having a second plurality of receiving connectors extending therein and positioned on each of the second pair of opposing sidewalls; and a second plurality of protrusions extending from each of the second pair of opposing sidewalls, wherein the interconnection between the first annular segment and the second annular segment is formed when the plurality of protrusions are received within and between each of the second plurality of receiving connectors within the second recess portion to couple the plurality of protrusions to the second plurality of receiving connectors such that the first annular segment extends from the second annular segment in a longitudinal direction.

* * * * *